United States Patent [19]

Young

[11] Patent Number: 4,758,824

[45] Date of Patent: Jul. 19, 1988

[54] ALARM FOR A BLIND

[75] Inventor: Philip Young, Washington, England

[73] Assignee: Heinz Jurgen Bernhard Fechner, Sunderland, England

[21] Appl. No.: 898,216

[22] Filed: Aug. 20, 1986

[30] Foreign Application Priority Data

Aug. 22, 1985 [GB] United Kingdom ..... 8521105
Sep. 10, 1985 [GB] United Kingdom ..... 8522266

[51] Int. Cl.[4] ..... G08B 13/00

[52] U.S. Cl. ..... 340/566; 340/541; 340/545; 340/550

[58] Field of Search ..... 340/566, 541, 511, 545, 340/693, 540, 548, 528, 550

[56] References Cited

U.S. PATENT DOCUMENTS

| | | | |
|---|---|---|---|
| 3,605,087 | 9/1971 | Nine | 340/528 |
| 3,668,582 | 6/1972 | Lea | 340/548 |
| 4,160,972 | 7/1979 | La Mell et al. | 340/545 |
| 4,281,320 | 7/1981 | Rosenberg | 340/550 |
| 4,636,775 | 1/1987 | Burgess et al. | 340/566 |

FOREIGN PATENT DOCUMENTS

| | | | |
|---|---|---|---|
| 0011451 | 5/1980 | European Pat. Off. | 340/566 |
| 2713127 | 3/1977 | Fed. Rep. of Germany | 340/550 |
| 3002528 | 7/1981 | Fed. Rep. of Germany | 340/550 |
| 2162669 | 2/1986 | United Kingdom | 340/550 |

*Primary Examiner*—Joseph A. Orsino
*Assistant Examiner*—Tat K. Wong
*Attorney, Agent, or Firm*—Rodman & Rodman

[57] ABSTRACT

An alarm device, suitable for use with venetian blinds and other retractable blinds and curtains, comprises, secured together as a single unit, a piezoelectric motion sensor, an amplifier circuit electrically connected to the piezoelectric sensor to amplify signals generated in the sensor, an audible alarm electrically connected to the amplifier circuit for activation by the amplified signals, and a source of electrical power for the circuit and the audible alarm. In one embodiment described, the unit is built upon a printed circuit board and is of such shape and dimensions as to fit in the bottom rail of a venetian blind.

3 Claims, 1 Drawing Sheet

ALARM FOR A BLIND

The present invention is an alarm device, suitable for use with venetian blinds and other retractable flinds, including roller blinds and vertical-louvre blinds.

Venetian blinds have been used for many years to reduce the amount of light, including sunlight, passing through a window and they are recognised also to be a deterrent to burglars. Other types of blinds, for example roller blinds, have been developed with the specific purpose of preventing unauthorised intrusion into a property.

Alarm devices have been used to give added security to blinds of these types but the installation of such known devices, which usually have been developed for other purposes, requires a level of skill not generally possessed by the average lay householder. However installation of such devices by a qualified specialist may prove sufficiently expensive to deter the householder from fitting such an alarm device.

It is an object of the present invention to provide a form of alarm device which is suitable for use with venetian blinds and the like but which is easy to install by an average competent householder.

The alarm device according to the present invention comprises, secured together as a single unit, a piezoelectric motion sensor, an amplifier circuit electrically connected to the piezoelectric sensor to amplify signals generated in the sensor, an audible alarm electrically connected to the amplifier circuit for activation by such amplified signals, and a source of electrical power for said circuit and for said audible alarm.

Because all of the above-specified components are secured together as a single unit, which is therefore wholly self-contained, the alarm device according to the present invention may be installed without difficulty by a householder of average competence. Indeed even "installation" as such may be unnecessary, since in one application of the invention, the device may simply be located in the bottom fold or hem of a curtain.

However, the device has primarily been devised with installation in a blind in mind. It may advantageously be made in a very compact form, optionally somewhat elongated in plan, so that it may be inserted into one end of the hollow bottom rail of a conventional venetian blind.

Piezoelectric motion sensors suitable for incorporation in an alarm device according to the present invention are readily available. Typically they comprise a plate of piezoceramic material or of piezoelectric crystalline material, which materials give rise to small voltage signals when the material is subjected to distortion such as occurs on a microscopic scale when the material is bent or squeezed by adjacent vibrations. Thus the sensor may comprise a flat disc of piezoelectric material, sandwiched between a conductive metal plate on its one side and a coating of electrically conductive material on the other, supporting a weight at a point adjacent to its centre and held around its circumference in a housing. In another form, it may comprise an elongated length of the material, supported at one end only so as to be free to flex in response to adjacent vibrations. In yet another form, the sensitivity of the sensor may be enhanced by providing, secured to the sensor, a roughened surface, especially a roughened spherical surface, over which a metal sphere is free to roll when disturbed by adjacent vibrations.

Advantageously, the alarm device is assembled upon a flat support, which in particular may be in the form of a printed circuit board upon which the electrical circuitry is formed by etching and to which the other components of the device, in particular the audible alarm and the power source, are secured.

The audible alarm may be a simple buzzer or other electrically-operated generator of a warning sound. However, if desired, the alarm may also incorporate a transmitter of radio signals, which signals may then remotely operate another alarm, which may provide a visual warning (for example a flashing light) or an audible warning that an intruder, or potential intruder, has disturbed the device according to the invention. Preferably the audible alarm is a "latched" alarm, which, once triggered, will continue to operate.

It is an important feature of the alarm device of the present invention that it incorporates its own source of electrical power. Other alarm devices usually rely upon an external power supply, which makes installation in general more difficult and scarcely practical in the case of flexible blinds or curtains. Because the present device relies upon a piezoelectric sensor, the power requirements are very small and the provision of an internal power supply becomes feasible. Thus the device may conveniently be powered by a simple dry-cell battery of the type used to power pocket calculators or clocks. A battery of this type may provide enough power to operate an alarm device according to the present invention for a year or more.

It is preferred that the alarm should not respond to every minor signal generated in the piezoelectric sensor; otherwise, the alarm may be triggered unnecessarily by non-intrusive vibrations and the credibility of the warning may be diminished. It is therefore desirable that the alarm device also incorporate a switch means responsive only to signals exceeding a predetermined threshold value. Preferably the amplified signals are fed to a solid-state switch, such as a thyristor, which in turn triggers the audible alarm when the signal exceeds the predetermined value. Less satisfactorily, the signals may operate a relay (which consumes more power than a solid-state switch).

The alarm device will also usually incorporate an on-off switch, so that the device will normally be switched on only when the security it affords is specifically required, and also to enable the audible alarm to be switched off when the warning has been given. A simple lever switch may be sufficient, since it is intended that the intruder should be immediately deterred by the audible alarm. However greater security is achieved if the switch is operable only by a key.

The circuit of the alarm device preferably also includes a delay means, so that the householder is allowed a short space of time, say 20 seconds, to adjust the blinds as desired after the unit has been switched on and before it becomes fully operative.

The invention will now be further described, and other features of the invention will be apparent, with reference to the accompanying drawings, wherein.

Figure 1:
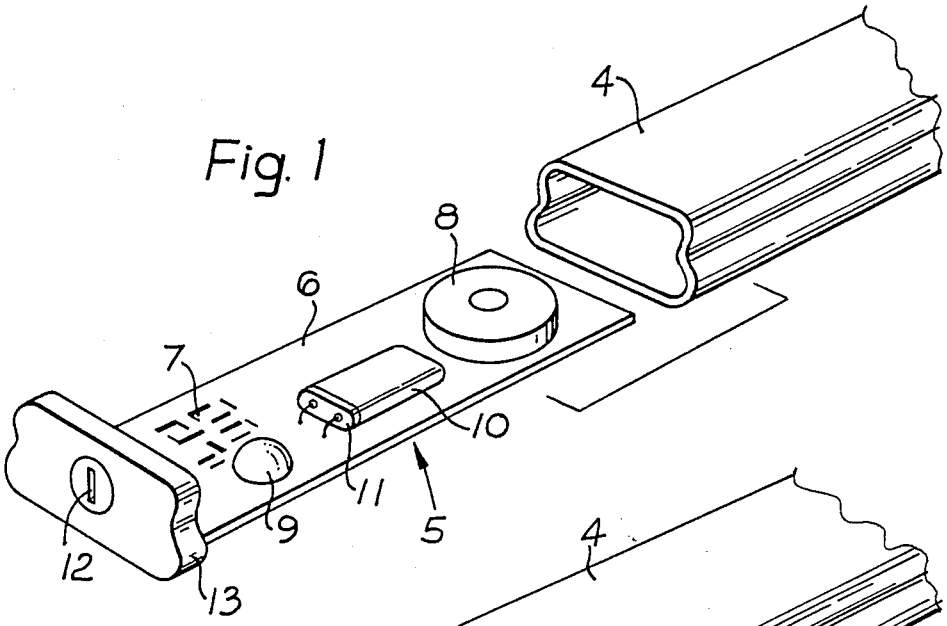
FIG. 1 illustrates, in perspective view, one embodiment of the alarm device according to the present invention about to be inserted into the bottom rail of a venetian blind.
Figure 2:
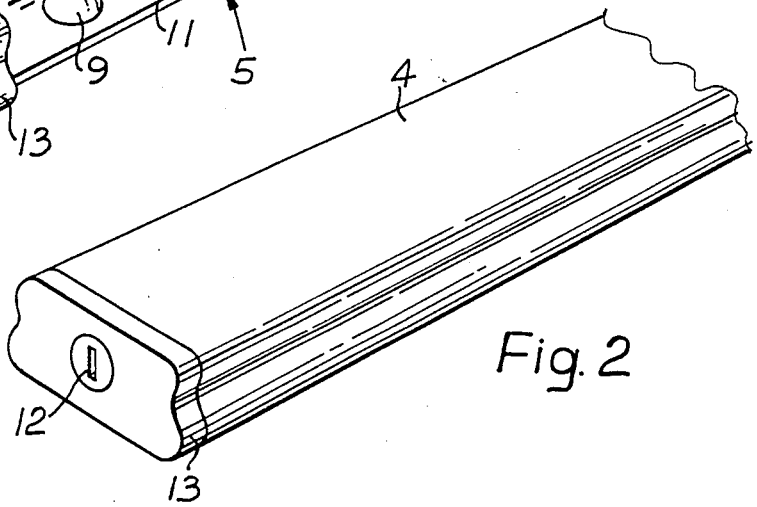
FIG. 2 illustrates the alarm device of FIG. 1, after insertion into the rail.

Referring firstly to FIGS. 1 and 2 of the drawings, the numeral 4 designates the bottom rail of a venetian blind, which conventionally is of generally flat cross-section such as illustrated and is hollow and of thin steel or aluminium. The illustrated alarm device 5 is built upon a printed circuit board (PCB) 6 as its base and the PCB 6 is slightly narrower than the interior width of the rail 4.

The circuit 7 printed upon the PCB is confined to a relatively small area thereof, so that there is ample space for the PCB also to support a buzzer 8, a piezoelectric sensor 9 and a small dry-cell battery 10, which latter is connected into the circuit by a push-on connector 11 to permit its easy replacement. The sensor 9 incorporates a spherical or, as illustrated, hemispherical housing having a roughened interior surface over which a small metal ball is free to move. Any vibration of the rail 4 causes the ball to move and that movement of the roughened surface gives an enhanced vibration, thereby giving a greater effect on the piezoelectric material within the sensor.

The illustrated unit incorporates a key-operated on-off switch 12, built into an end-cap 13 of plastics material which is a push-on fit over the end of the rail 4.

Figure 3:
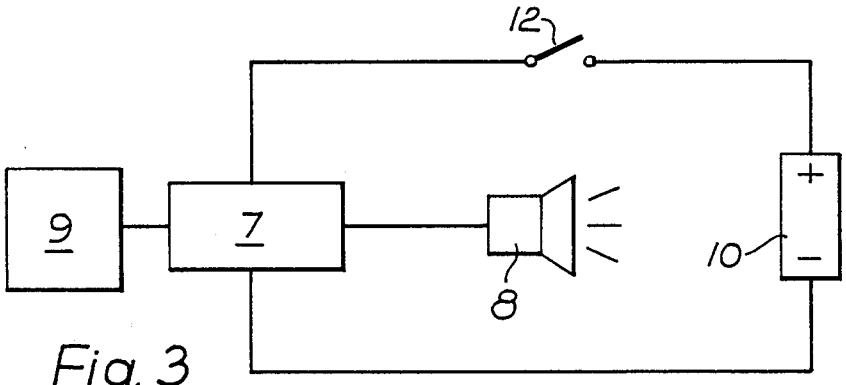
FIG. 3 is a schematic diagram of the electric circuit of the device of FIG. 1.

FIG. 3 illustrates schematically the electrical interconnection of the components of the alarm device shown in FIGS. 1 and 2. The same reference numerals have been used in FIG. 3 to designate components illustrated in FIGS. 1 and 2.

When the householder wishes to install the device in an existing blind, he simply has to insert the unit endwise into the rail 4 until the cap 13 is fitted over the end of the rail. To activate the device, for example at night or when the house is unoccupied, he inserts the key into the switch 12 and turns it to the "on" position, then withdrawing the key as an extra safety precaution if desired. Power is thus supplied by the battery 10 to the PCB circuit 7 but a time delay device in the circuit ensures that the alarm is not operative for a short period, say 20 seconds, during which the householder may adjust the blind to its desired position.

Thereafter, any piezoelectric signal generated in the sensor 9 by movement of the blind by an intruder or by any other adjacent vibration is passed to the circuit 7, wherein it is amplified and passed to a solid-state switch in the circuit. When a signal sufficient to trigger the switch is received, the audible alarm (the buzzer 8) is activated and continues to sound until power is removed by the switching of the switch 12 to the "off" position.

While the illustrated device has been described specifically as applied to a venetian blind, it is wholly suitable, modified if desired, for incorporation in the bottom rail of a roller blind or for putting into the pocket or hem of a vertical louvre blind or of a curtain.

I claim:

1. A self-contained portable alarm device, suitable for fitting to a blind of the type of venetian blinds, vertical louvre blinds and roller blinds and for insertion into a fold in a curtain, which alarm device comprises:

(a) a printed circuit board for fitting to said blind and for insertion into said fold;

(b) a piezoelectric motion sensor mounted upon said printed circuit board;

(c) said piezoelectric motion sensor including a flat plate of piezoelectric material mounted to flex in response to motion in its vicinity and thereby produce electrical signals therein;

(d) an amplifier circuit in said printed circuit, electrically connected to said piezoelectric motion sensor to receive electric signals produced in said sensor and to amplify said signals;

(e) a solid-state switch mounted upon said printed circuit board and electrically connected to receive amplified signals from said amplifier circuit;

(f) an audible alarm mounted upon said printed circuit board and electrically connected to said solid-state switch to be activated by said switch;

(g) a battery mounted upon said printed circuit board and connected to supply electric power to said amplifier circuit and to said audible alarm;

(h) an on-off switch electrically connected to interrupt said electric power supply from said battery; and (i) time delay means upon said printed circuit board to delay said alarm being made operative for a predetermined short time after said on-off switch has been switched on.

2. An alarm device according to claim 1, wherein said audible alarm is a latched alarm.

3. An alarm device according to claim 1 wherein said printed circuit board and said on-off switch constitute a self-contained portable unit.

* * * * *